United States Patent [19]

Suzuki et al.

[11] Patent Number: 4,771,146

[45] Date of Patent: Sep. 13, 1988

[54] KEYBOARD KEY TOP MOUNTING STRUCTURE

[75] Inventors: Hideki Suzuki; Kazuhiro Yokoyama, both of Iwaki, Japan

[73] Assignee: Alps Electric Co., Ltd., Tokyo, Japan

[21] Appl. No.: 125,735

[22] Filed: Nov. 30, 1987

Related U.S. Application Data

[63] Continuation of Ser. No. 897,703, Aug. 18, 1986, abandoned.

[30] Foreign Application Priority Data

Aug. 19, 1985 [JP] Japan ..... 60-126210[U]
Aug. 19, 1985 [JP] Japan ..... 60-126211[U]

[51] Int. Cl.[4] ..... H01H 3/12
[52] U.S. Cl. ..... 200/340; 200/5 A; 400/496
[58] Field of Search ..... 200/340, 5 A, 327, 335, 200/337; 400/496

[56] References Cited

U.S. PATENT DOCUMENTS

| | | | |
|---|---|---|---|
| 3,720,801 | 3/1973 | Yanaga | 400/496 |
| 3,939,318 | 2/1976 | Brown et al. | 200/340 |
| 4,010,838 | 3/1977 | Sims, Jr. | 400/496 |
| 4,392,037 | 7/1983 | Fleming | 200/340 |
| 4,453,063 | 6/1984 | Wanatowicz, Jr. et al. | 200/340 |
| 4,535,210 | 8/1985 | Shedore et al. | 200/340 |

*Primary Examiner*—Henry J. Recla
*Assistant Examiner*—Linda J. Sholl
*Attorney, Agent, or Firm*—Guy W. Shoup; Leighton K. Chong; Paul J. Winters

[57] ABSTRACT

A keyboard key top mounting structure including a plurality of lever support means provided on the back of a key top, the lever support means being each provided with wing portions for abutment therewith of a lever to prevent the lever from pivoting during mounting of the lever, and a plurality of lever sliding members provided on the side of a stationary member and each having a lever sliding slot, in which the lever is supported by the lever support means and inserted into the sliding slots.

3 Claims, 7 Drawing Sheets

KEYBOARD KEY TOP MOUNTING STRUCTURE

This is a continuation application from application Ser. No. 897,703 filed 08/18/86, now abandoned,

BACKGROUND OF THE INVENTION

1. Field of the Invention

The present invention relates to a structure for mounting a key top of a keyboard used in various input devices of personal computers, word processors, etc. Particularly, it is concerned with a keyboard key top mounting structure which is effective in improving the lever assembling work efficiency between lever support means attached to a key top and components mounted on a stationary member side such as a printed circuit board and which is suitable for a smooth operation of a lever.

2. Description of the Prior Art

FIG. 11 is a development view of a conventional key top mounting structure of a large key size.

According to the prior art illustrated in FIG. 11, lever support means 2–5 are attached to the back of a key top 1 of a large key size and a stem engaging projection 8 is formed on the same side. Among the lever support means 2–5, a set of the lever support means 2 and 3 are for engagement with end portions 6*a* and 6*b* of a lever 6, while a set of the lever support means 4 and 5 are for engagement with end portions 7*a* and 7*b* of another lever 7.

On the other hand, lever fitting portions 10–13 are attached to a stationary member 9 such as a printed circuit board or a panel and a push-button switch 14 is provided on the same side. Among the lever fitting portions 10–13, a set of the lever fitting portions 10 and 11 are for fitting therein of an intermediate portion of the lever 6, while a set of the lever fitting portions 12 and 13 are for fitting therein of an intermediate portion of the other lever 7. The push-button switch 14 is provided with a stem 15 having a fitting hole 16.

The stem engaging projection 8 formed on the key top 1 is fitted in the lever fitting hole 16 of the stem 15 in the course of engagement of the levers 6 and 7 with the lever fitting portions 10, 11 and 12, 13, respectively.

In the above conventional key top mounting structure, the levers 6 and 7 are freely pivotable using as fulcrums their end portions 6*a*, 6*b* and 7*a*, 7*b* engaged with the lever support means 2, 3 and 4, 5, respectively. Therefore, the levers 6 and 7 pivot when fitted in the lever fitting portions 10, 11 and 12, 13, respectively, and thus the lever assembling work efficiency is very bad.

SUMMARY OF THE INVENTION

It is the object of the present invention to provide a keyboard key top mounting structure capable of overcoming the above-mentioned problems of the prior art and improving the lever assembling work efficiency and permitting a smooth operation of levers.

The present invention is characterized in that a plurality of lever support means are provided on the back of a key top, the lever support means being each provided with wing portions for abutment therewith of a lever to prevent the lever from pivoting during mounting of the lever, and a plurality of lever sliding members each having a lever sliding slot are provided on the side of a stationary member, the lever being supported by the lever support means and inserted into the sliding slots.

BRIEF DESCRIPTION OF THE DRAWINGS

FIGS. 1 to 10 illustrate an embodiment of the present invention, of which:

FIG. 1 is a front view of a key top mounting structure being assembled; FIG. 2 is a front view thereof after assembly; FIG. 3 is a development view thereof before assembly; FIG. 4 is an enlarged plan view of a lever support means; FIG. 5 is a front view thereof; FIG. 6 is an enlarged plan view of another lever support means; FIG. 7 is a front view thereof; FIG. 8 is a rear view thereof; FIG. 9 is an enlarged front view of a lever sliding member; FIG. 10 is a left side view of FIG. 9.

DESCRIPTION OF A PREFERRED EMBODIMENT

Figure 3:
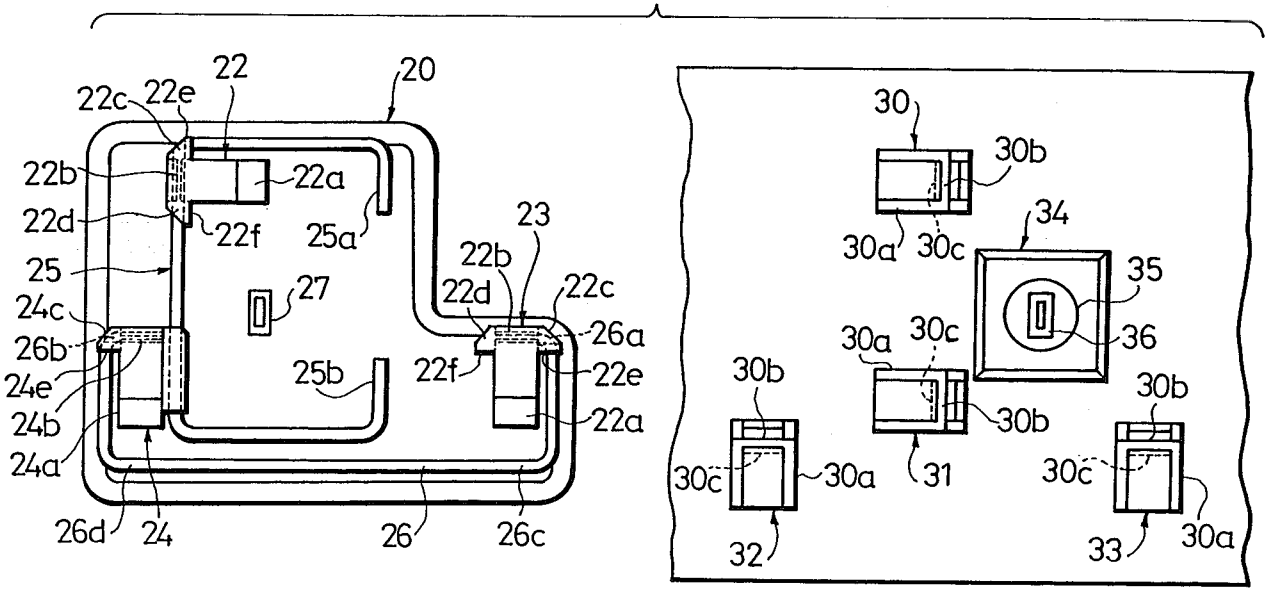
Figure 4:
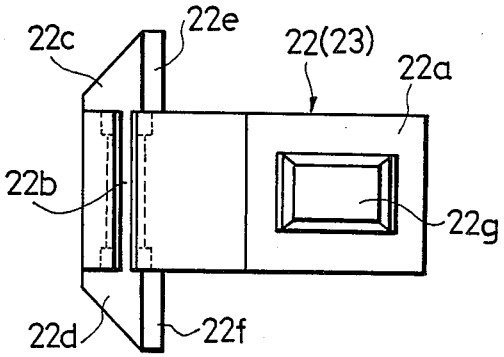
Figure 5:
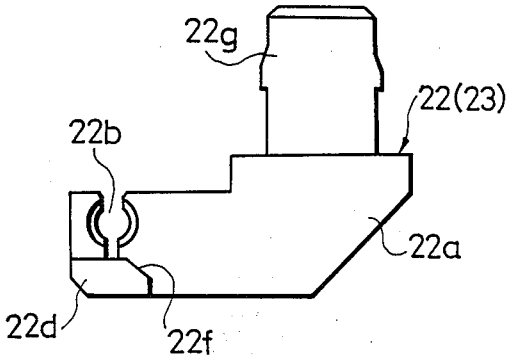

An embodiment of the present invention will be described in detail hereinunder with reference to the drawings. As shown in FIG. 3, a key top mounting structure of this embodiment includes lever support means 22, 23 and 24 attached to the back of a key top 20; a lever 25 engaged between the lever support means 22 and 24; a lever 26 engaged between the lever support means 23 and 24; a stem engaging projection 27 formed on the back of the key top 20; lever sliding members 30–33 attached to a stationary member 28 such as a printed circuit board or a panel; and a push-button switch 34 also attached to the stationary member 28.

Figure 1:
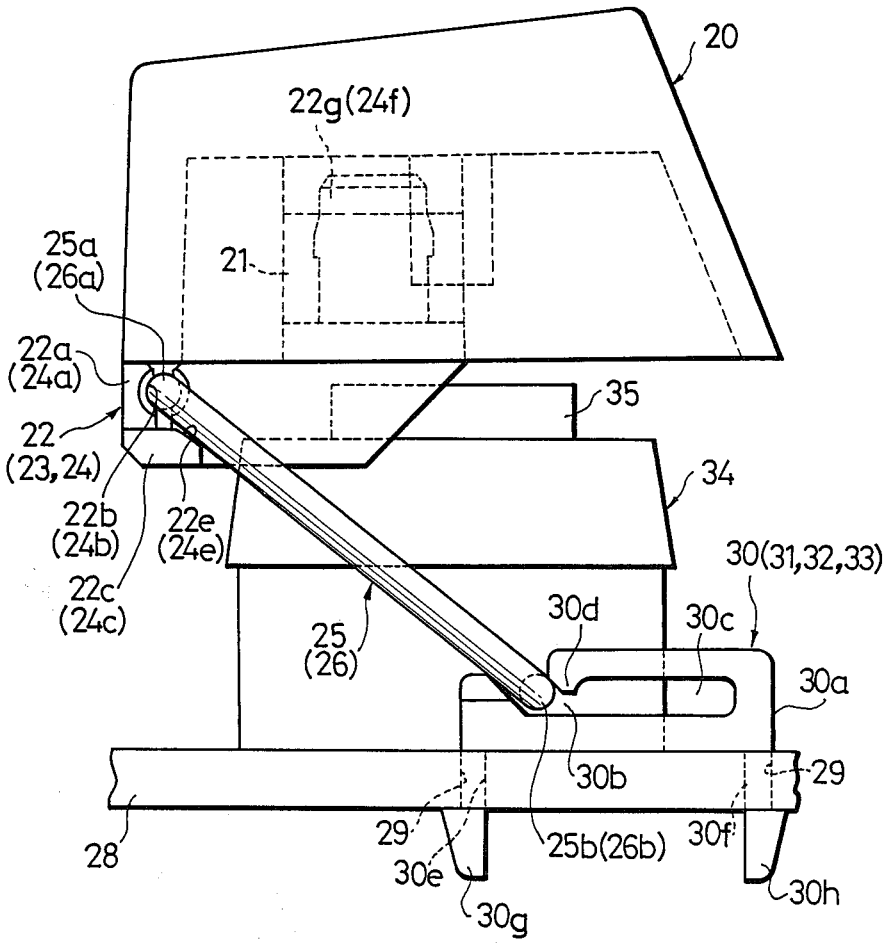
Figure 2:
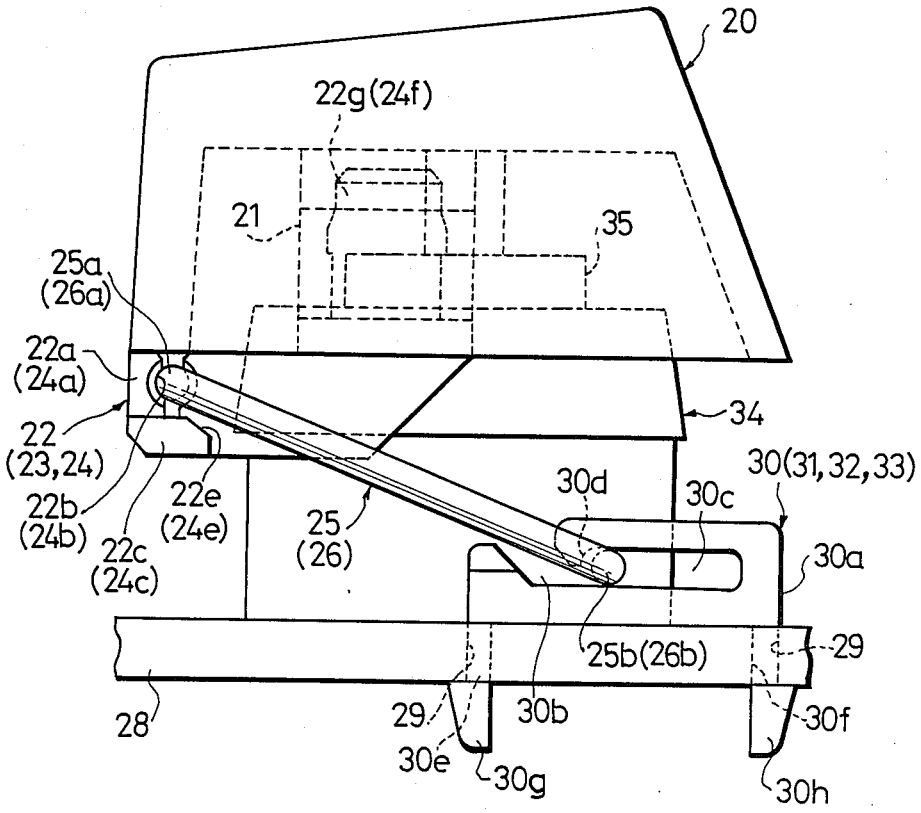

As shown in FIGS. 1 to 5, the lever support means 22 and 23 are each provided with a body 22*a*; a lever fitting slot 22*b* formed in one end portion of the body 22*a*; wing portions 22*c* and 22*d* projecting on both sides from the same one end portion; slant faces 22*e* and 22*f* formed at the wing portions 22*c* and 22*d*; and an inserting projection 22*g* formed at an opposite end portion of the body 22*a*. The lever 25 or 26 can be fitted in the lever fitting slot 22*b* in a snap-in fashion. The lever 25 or 26 fitted in the lever fitting slot 22*b* is held in abutment with the slant face 22*e* and 22*f*, whereby at the time of its mounting it is prevented from pivoting and is held at a preset angle. As shown in FIGS. 1 and 2, the inserting projection 22*g* is inserted into a receptacle portion 21 provided at the back of the key top 20 and through this connection between the receptacle portion 21 and the inserting projection 22*g* the lever support means 22 and 23 are mounted to the key top 20.

Figure 6:
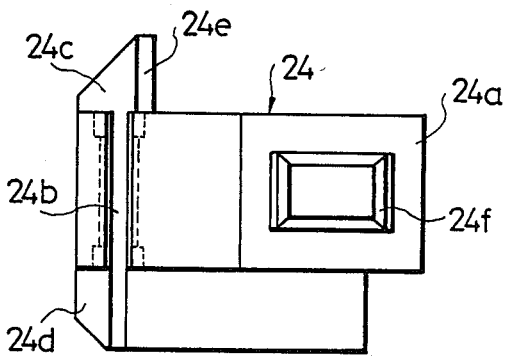
Figure 7:
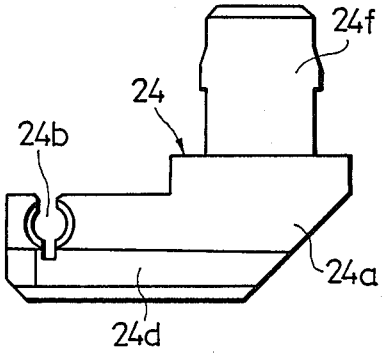
Figure 8:
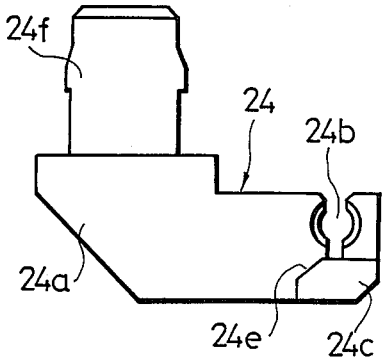
Figure 9:
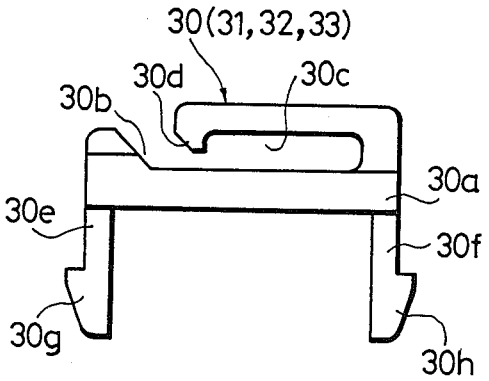
Figure 10:
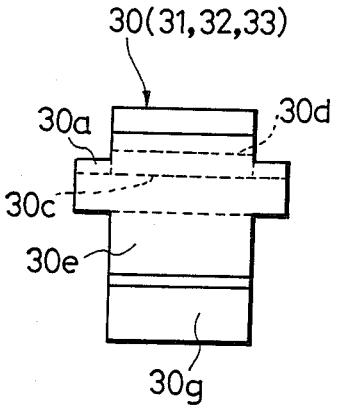
Figure 11:
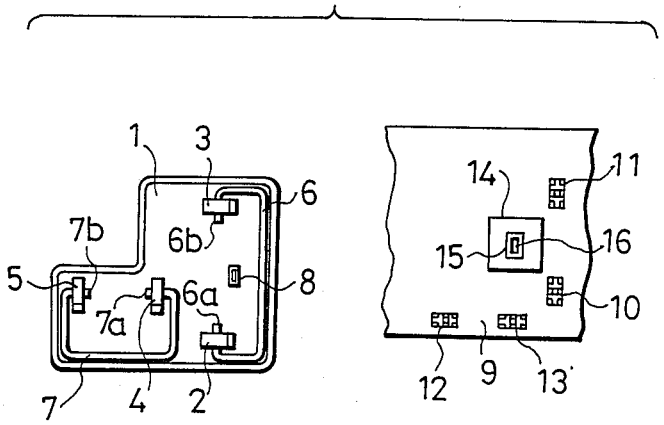
Fig.11 PRIOR ART
FIG. 11 is a development view of a conventional key top mounting structure of a large key size.

As shown in FIGS. 6 to 8, the lever support means 24 has a body 24*a*, a lever fitting slot 24*b* formed in one end portion of the body 24*a*; wing portions 24*c* and 24*d* projecting on both sides from the body 24*a*; a slant face 24*e* formed at one wing portion 24*c*; an inserting projection 24*f* formed at an opposite end portion of the body 24*a*; and a slot 24*g* formed in the wing portion 24*d*. The lever 26 can be fitted in the lever fitting slot 24*b* in a snap-in fashion. The lever 26 fitted in the lever fitting slot 24*b* is held in abutment with the slant face 24*e* of one wing portion 24*c*, whereby at the time of its mounting it is prevented from pivoting and is held at a preset angle. The slot 24*b* formed in the other wing portion 24*d* functions to support an intermediate portion of the lever 25. The inserting projection 24*f* is inserted into the receptacle portion 21 provided at the back of the key top 20 and through this connection between the receptacle portion 21 and the inserting projection 24*f* the lever support means 24 is mounted to the key top 20.

The lever 25 is ]-shaped in plan and both end portions 25*a* and 25*b* thereof are bent in directions facing each other. The lever 25 is fitted in the lever fitting slot 22*b* of the lever support means 22 and at the time of its mounting it comes into abutment with the slant faces 22*e* and 22*f* of the wing portions 22*c* and 22*d* provided on both sides of the lever support means 24 and is thereby prevented from pivoting in excess of a preset angle. Further, the lever 25 is supported by the slot 24*b* of the lever support means 24 and its end portions 25*a* and 25*b* are fitted in the lever sliding members 30 and 31.

The lever 26 is ] - shaped in plan and both end portions 26*a* and 26*b* thereof are bent in directions facing each other. The lever end portions 26*a* and 26*b* are fitted, in a snap-in fashion, in the lever fitting slot 22*b* formed in the lever support means 23 and the lever fitting slot 24*b* formed in the lever support means 24. Besides, when mounting, the lever 26 comes into abutment with the slant face 22*e* formed at the wing portion 22*c* of the lever support means 23 and the slant face 24*e* formed at the wing portion 24*c* of the lever support means 24 and is thereby prevented from pivoting in excess of a preset angle. Further, bent portions 26*c* and 26*d* of the lever 26 are fitted in the lever sliding members 32 and 33.

In the stationary member 28, e.g. a printed circuit board or a panel, are formed insertion holes 29 for insertion therein of the lever sliding members 30–33.

The lever sliding members 30–33, which are formed in the same shape, are each provided with a body 30*a*, a lever end guide portion 30*b*, a lever end sliding slot 30*c* and leg portions 30*e*, 30*f*. The sliding slot 30*c* is ] - shaped in front view and a projecting portion 30*d* is formed at a fore end of the slot 30*c*. Into the sliding slot 30*c* is inserted an end portion of the associated lever through the guide portion 30*b*, slidably in a snap-in fashion by pushing up the projecting portion 30*d*. The slots 30*c* of the lever sliding members 30–33 are each formed so that a clearance may not be formed between the projecting portion 30*d* and the lever end portion in a lever mounted state in which the lever end portion is inserted into the slot 30*c*. Fore end portions of the legs 30*e* and 30*f* are formed with retaining projections 30*g* and 30*h*, respectively. By inserting the legs 30*e* and 30*f* into the insertion holes 29 formed in the stationary member 28, the engaging projections 30*g* and 30*h* are engaged with the stationary member 28 and thus the lever sliding members 30–33 are mounted to the stationary member 28.

The push-button switch 34 is provided with a stem 35 which has a fitting hole 36 for the stem engaging projection. The stem 35 is projected up to a predetermined position by means of a spring (not shown) incorporated in the switch 34.

For assembling the key top mounting structure of this embodiment, the lever 26 is fitted in a snap-in fashion into the lever fitting slot 22*b* of the lever support means 23 and the lever fitting slot 24*b* of the lever support means 24, as shown in FIG. 1. Further, the lever 25 is fitted in the lever fitting slot 22*b* of the lever support means 22 in a snap-in fashion and it is put on the slot 24*g* of the lever support means 24.

Then, the inserting projections 22*g* of the lever support means 22 and 23 as well as the inserting projection 24*f* of the lever support means 24 are inserted into the receptacle portions 21 provided at the back of the key top 20 to fix the lever support means 22, 23 and 24.

Then, the end portions 25*a* and 25*b* of the lever 25 and the bent portions 26*c* and 26*d* of the lever 26 are attached to the lever sliding members 30, 31 and 32, 33, respectively.

When the levers 25 and 26 are mounted to the lever sliding members 30, 31 and 32, 33, as can be seen from FIG. 1, one lever 25 comes into abutment with the slant faces 22*e* and 22*f* formed at the wing portions 22*c* and 22*d* of the lever support means 22 and this thereby prevented from pivoting in excess of a preset angle, while the other lever 26 comes into abutment with the slant face 22*e* formed at the wing portion 22*c* of the lever support means 23 and also with the slant face 24*e* formed at one wing portion 24*c* of the lever support means 24 and is thereby prevented from pivoting in excess of a preset angle.

Thus, the lever 25 is held in a non-pivoting stable posture by the slant faces 22*e* and 22*f* of the wing portions 22*c* and 22*d* of the lever support means 22. The end portions 25*a* and 25*b* of the lever 25 are introduced into the guide portions 30*b* of the lever sliding members 30 and 31, then by pushing in the lever 25 the projecting portions 30*d* are pushed up, allowing those lever end portions to be inserted into the sliding slots 30*c* in a snap-in fashion. The lever 26 is also held in a non-pivoting stable posture by both the slant face 22*e* of the wing portion 22*c* of the lever support means 23 and the slant face 24*e* of the wing portion 24*c* of the lever support means 24. The bent portions 26*c* and 26*d* of the lever 26 are introduced into the guide portions 30*b* of the lever sliding members 32 and 33, then by pushing in the lever 26 the projecting portions 30*d* are pushed up, allowing those bent portions to be inserted into the sliding slots 30*c* in a snap-in fashion. During this operation, the stem engaging projection 27 formed on the back of the key top 20 is fitted in the fitting hole 36 formed in the stem 35 of the push-button switch 34. Now the key top mounting structure is assembled in the state of use shown in FIG. 2.

In this embodiment, as set forth above, the levers 25 and 26 are prevented from pivoting in excess of a preset angle by the slant faces 22*e*, 22*f* and 24*e* formed at the wing portions 22c, 22*d* and 24*c* of the lever support means 22, 23 and 24 and are thereby prevented from pivoting in excess of a present angle at the time of mounting of those levers, so the end portions 25*a* and 25*b* of one lever 25 can be easily inserted into the sliding slots 30*c* of the lever sliding members 30 and 31, while the bent portions 26*c* and 26*d* of the other lever 26 can be easily inserted into the sliding slots 30*c* of the lever sliding members 32 and 33.

In the lever mounted state in which the end portions 25*a* and 25*b* of one lever 25 are inserted into the sliding slots 30*c* of the lever sliding members 30 and 31 while the bent portions 26*c* and 26*d* of the other lever 26 are inserted into the sliding slots 30*c* of the lever sliding members 32 and 33, there is formed no clearance between the projecting portions 30*d* of the lever sliding members 30–33 and the lever end portions, so there is no rocking of the key top 20 on a plane and hence it is possible to prevent key tops from contacting each other.

In use, when the key top 20 is pushed against the spring incorporated in the push-button switch 34 from the state shown in FIG. 2, the end portions 25*a* and 25*b* of one lever 25 move along the sliding slots 30*c* of the lever sliding members 30 and 31, while the bent portions 26*c* and 26*d* of the other lever 26 move along the sliding slots 30*c* of the lever sliding members 32 and 33, thus permitting a smooth operation of the push-button switch 34.

Upon release of the key top 20, the key top returns to its original position by virtue of the spring in the push-button switch 34 and the levers 25 and 26 are also returned to the respective original positions.

The present invention is applicable not only to the key top of a large size using two levers as in the embodiment illustrated in the drawings, but also to a key top of a small size.

According to the present invention, as set forth hereinabove, a plurality of lever support means attached to the back of the key top are provided with wing portions for abutment therewith and thereby preventing a pivotal motion of levers at the time of mounting of the levers, so the levers are prevented from pivoting in excess of a preset angle and can be held in a stable posture, thus permitting an improvement of the lever assembling work efficiency and reduction of cost.

According to the present invention, moreover, since a plurality of lever sliding members each having a sliding slot are provided on the side of a stationary member and the levers attached to the lever support means are inserted into those sliding slots, the levers can be operated smoothly along the sliding slots and hence the key top can be operated lightly.

What is claimed is:

1. A keyboard key top mounting structure comprising:

a key top having at least one receptacle formed in a bottom portion thereof;

a substrate having a push-button member over which said key top is mounted by said key top mounting structure such that said key top can be actuated for operating said push-button member, said substrate further having at least one lever holding member fixed thereon;

a lever for holding said key top over said push-button member of said substrate, said lever including a mounting portion at one end and at least one holding portion at an opposite end which is inserted in said lever holding member of said substrate when said key top is assembled on said substrate; and at least one lever support member assembled to said key top having a projection on an upper portion thereof for insertion in said receptacle of said key top, and a slot for pivotally mointing said mounting portion of said lever therein, wherein said slot of said lever support member is disposed under said key top laterally to one side of said push-button member and said lever holding member of said substrate is disposed to an opposite side of said push-button member, so that said lever extends at a downward slanting angle between said slot and said lever holding member, and wherein said lever support member (22) assembled to said key top include a downwardly slanting surface (22*e*) proximate said slot (22*b*) which limits a downward inclination of said lever (25) to a predetermined angle when said lever mounting portion (25*a*) is mounted is said slot, and said lever holding member (30) includes an inclined guide portion (30*b*) for receiving said holding portion (25*b*) of said lever at said predetermined angle, whereby, when said key top mounting structure is assembled with said lever mounting portion in said slot of said lever support member, and with said projection of said lever support member inserted in said receptacle of said key top, said assembled key top, lever support member, and lever can then be easily mounted to said substrate by said lever being held at said predetermined angle by said slanting surface of said lever support member for insertion in said inclined guide portion of said lever holding member of said substrate.

2. A key top mounting structure according to claim 1, having a plurality of said lever support members assembled to said bottom portion of said key top, wherein said lever mounting portion is mounted in two or more of said lever support members, said lever being formed in a C-shape having two holding ends, one on each side of said mounting portion, and said substrate having two lever holding members for insertion of said two holding ends.

3. A key top mounting structure according to claim 1 wherein said lever holding end is formed as a bent end, and said lever holding member of said substrate has a sliding slot defined by an upper arm provided with a projecting portion at an insertion entrance to said sliding slot, wherein said bent end of said lever is snapped into said entrance past said projecting portion so as to be slidably held in said slot of said lever holding member.

* * * * *